US012140335B2

(12) United States Patent
Hwang et al.

(10) Patent No.: US 12,140,335 B2
(45) Date of Patent: Nov. 12, 2024

(54) CEILING TYPE AIR CONDITIONER

(71) Applicant: LG ELECTRONICS INC., Seoul (KR)

(72) Inventors: Bonchang Hwang, Seoul (KR); Beomsoo Seo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 528 days.

(21) Appl. No.: 17/423,776

(22) PCT Filed: Jan. 17, 2020

(86) PCT No.: PCT/KR2020/000864
§ 371 (c)(1),
(2) Date: Jul. 16, 2021

(87) PCT Pub. No.: WO2020/149698
PCT Pub. Date: Jul. 23, 2020

(65) Prior Publication Data

US 2022/0113059 A1 Apr. 14, 2022

(30) Foreign Application Priority Data

Jan. 18, 2019 (KR) ..... 10-2019-0006769

(51) Int. Cl.
*F24F 13/08* (2006.01)
*F24F 1/0011* (2019.01)
(Continued)

(52) U.S. Cl.
CPC ..... *F24F 13/081* (2013.01); *F24F 1/0011* (2013.01); *F24F 1/0047* (2019.02);
(Continued)

(58) Field of Classification Search
CPC ..... F24F 13/081; F24F 1/0047; F24F 1/0011; F24F 13/082; F24F 13/12; F24F 13/222;
(Continued)

(56) References Cited

U.S. PATENT DOCUMENTS 3,766,750 A * 10/1973 Aoh ..... F24F 1/035 62/426
5,577,958 A * 11/1996 Kumekawa ..... F15D 1/04 454/304

(Continued)

FOREIGN PATENT DOCUMENTS

CN 101761987 6/2010
CN 107429924 12/2017

(Continued)

OTHER PUBLICATIONS

International Search Report dated May 14, 2020 issued in Application No. PCT/KR2020/000864.

(Continued)

*Primary Examiner* — Paul Alvare
(74) *Attorney, Agent, or Firm* — KED & ASSOCIATES

(57) ABSTRACT

Disclosed is a ceiling type air conditioner that can implement a horizontal air flow to provide an indirect wind to a user with a simple structure. To this end, the ceiling type air conditioner according to the present disclosure includes an inner case in which a blower and a heat exchanger are built-in, and a blow passage for guiding air passed through the heat exchanger downward is formed; an inner flow path body which is disposed below the inner case and has a suction flow path for sucking air into the inner case so as to communicate vertically; and an outer flow path body which is spaced outward from the inner flow path body and disposed below the inner case, and forms a discharge flow path, between the inner flow path body, communicating with the blow passage; wherein an outer circumferential surface (Continued)

of the inner flow path body comprises a first concave portion formed to be concave, a first horizontal portion extended horizontally outwardly from a lower end of the first concave portion, and a vertical portion extended vertically downwardly from an outer end of the first horizontal portion.

19 Claims, 4 Drawing Sheets

(51) Int. Cl.
*F24F 1/0047* (2019.01)
*F24F 13/12* (2006.01)
*F24F 13/22* (2006.01)

(52) U.S. Cl.
CPC ..... *F24F 13/082* (2013.01); *F24F 13/12* (2013.01); *F24F 13/222* (2013.01); *F24F 2013/088* (2013.01); *F24F 2221/14* (2013.01)

(58) Field of Classification Search
CPC ..... F24F 2013/088; F24F 2221/14; F24F 1/0038; F24F 1/0014; F24F 13/14; F24F 13/1426; F24F 2013/1433; F24F 2013/1446; F24F 1/028; F24F 1/0317
USPC ..... 165/53
See application file for complete search history.

(56) References Cited

U.S. PATENT DOCUMENTS

| | | | | |
|---|---|---|---|---|
| 6,370,907 | B1 * | 4/2002 | Sekiguchi | F24F 1/0011 62/426 |
| 2002/0152760 | A1 * | 10/2002 | Okuda | F24F 13/20 62/426 |
| 2004/0050077 | A1 * | 3/2004 | Kasai | F24F 1/0011 454/304 |
| 2004/0244403 | A1 * | 12/2004 | Kim | F24F 1/0022 62/419 |
| 2006/0010901 | A1 * | 1/2006 | Iwata | F24F 1/0047 62/426 |
| 2008/0035317 | A1 * | 2/2008 | Choi | F24F 1/0063 165/125 |
| 2010/0175411 | A1 * | 7/2010 | Choi | F24F 1/0047 62/426 |
| 2015/0276246 | A1 | 10/2015 | Kono et al. | |
| 2017/0115027 | A1 | 4/2017 | Lee et al. | |
| 2018/0306452 | A1 | 10/2018 | Kim et al. | |

FOREIGN PATENT DOCUMENTS

| | | |
|---|---|---|
| EP | 2775226 | 5/2018 |
| JP | 08-94160 | 4/1996 |
| JP | 3240854 | 12/2001 |
| JP | 2007-333356 | 12/2007 |
| JP | 2008-057843 | 3/2008 |
| JP | 2010-038490 | 2/2010 |
| KR | 10-1998-0030506 | 7/1998 |
| KR | 10-2009-0080747 | 7/2009 |
| KR | 10-2017-0048128 | 5/2017 |
| KR | 10-2018-0089748 | 8/2018 |
| KR | 10-2018-0103534 | 9/2018 |
| KR | 20180103545 A * | 9/2018 |
| KR | 10-2018-0129074 | 12/2018 |
| KR | 10-2018-0129075 | 12/2018 |

OTHER PUBLICATIONS

Chinese Office Action dated May 7, 2022 issued in Application No. 202080009882.1 (English translation attached).
European Search Report dated Sep. 9, 2022 issued in Application No. 20741148.9.
Korean Office Action issued in Application No. 10-2019-0006769 dated Apr. 18, 2023.

* cited by examiner

【FIG. 1】
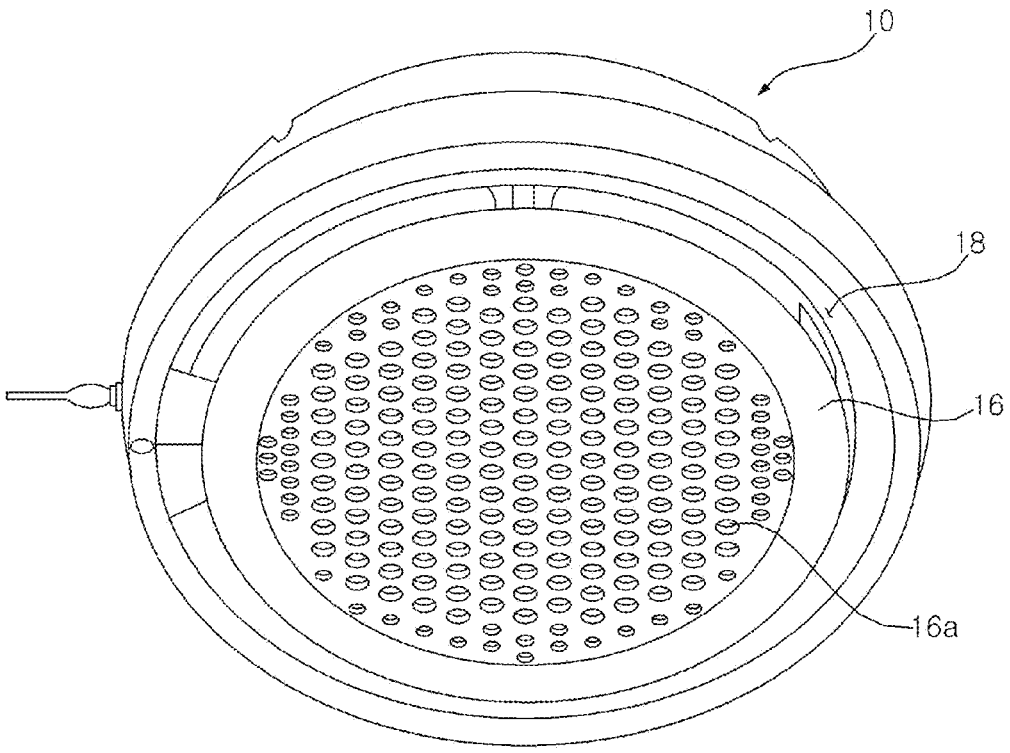

【FIG. 2】
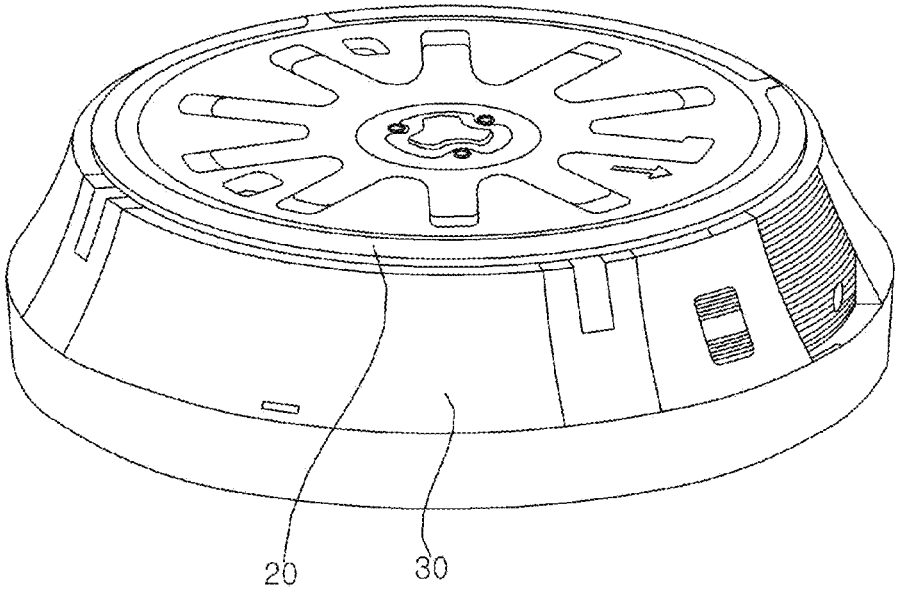
【FIG. 3】
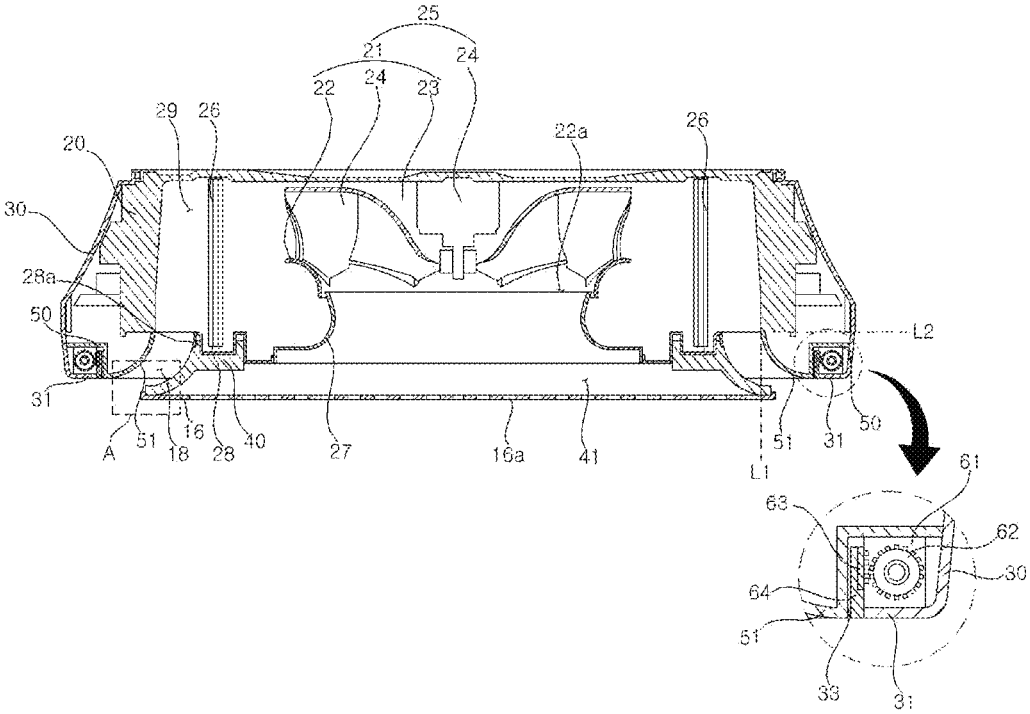

【FIG. 4】
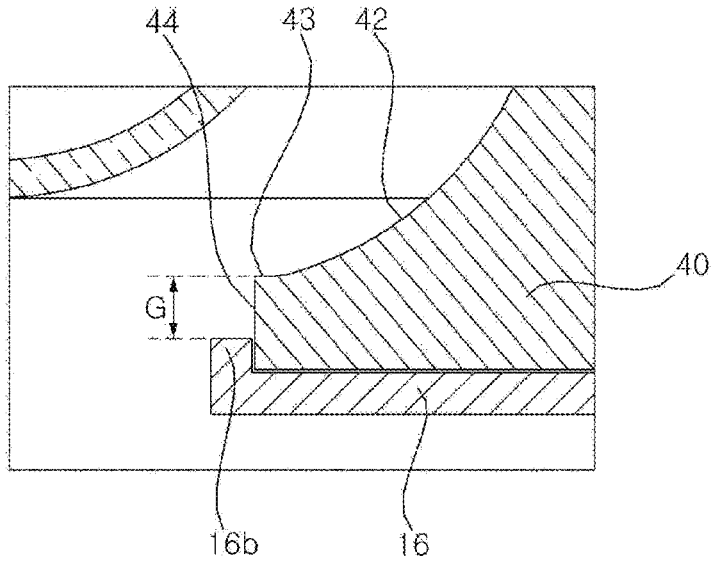
【FIG. 5】
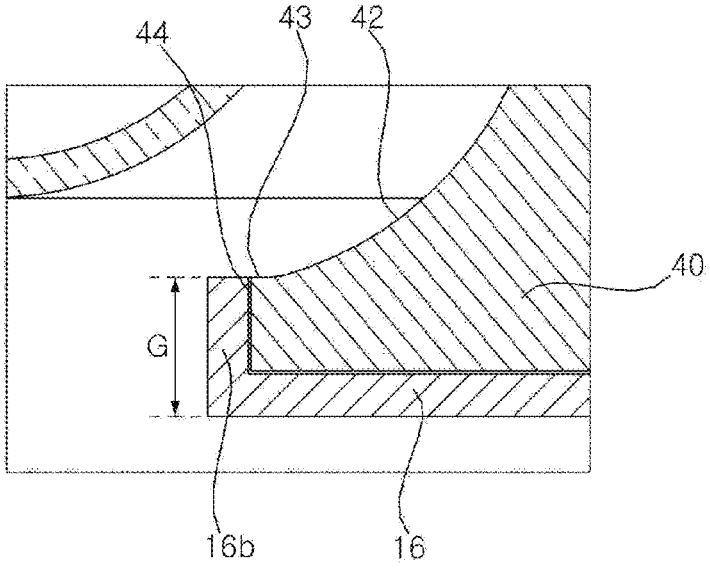

【FIG. 6】
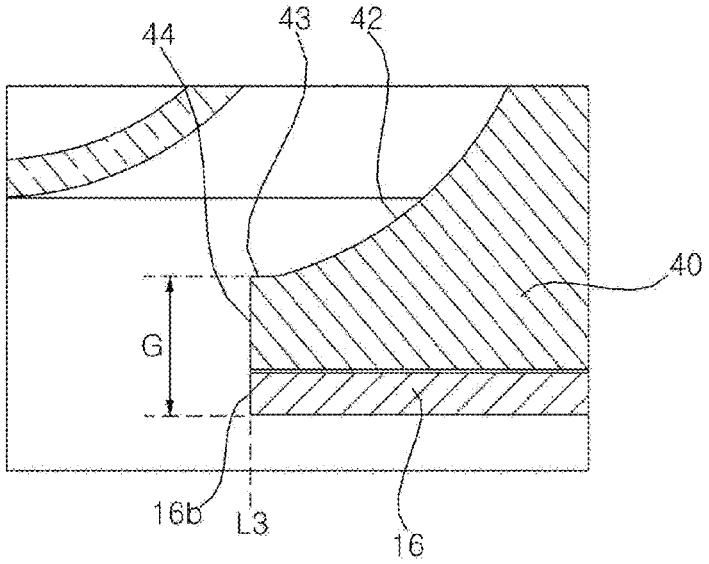
【FIG. 7】
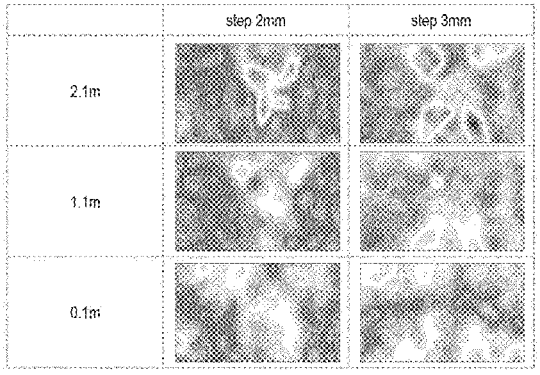

CEILING TYPE AIR CONDITIONER

CROSS-REFERENCE TO RELATED PATENT APPLICATIONS

This application is a U.S. National Stage Application under 35 U.S.C. § 371 of PCT Application No. PCT/KR2020/000864, filed Jan. 17, 2020, which claims priority to Korean Patent Application No. 10-2019-0006769, filed Jan. 18, 2019, whose entire disclosures are hereby incorporated by reference.

TECHNICAL FIELD

The present disclosure relates to a ceiling type air conditioner, and more particularly, to a ceiling type air conditioner that provides indirect wind to a user.

BACKGROUND ART

A ceiling type air conditioner is installed in the ceiling of a room, and discharges a conditioned air to the room.

Conventional ceiling type air conditioners are mostly a four-way type with four discharge ports. That is, in the ceiling type air conditioner of four-way type, the air discharge port is provided one by one in each side of four directions, so that the air discharge port is configured of a left air discharge port, a right air discharge port, a front air discharge port, and a rear air discharge port.

The ceiling type air conditioner of four-way type has vanes for controlling the direction of discharged air in each of the air discharge ports. One end of the vane is coupled to the rotation shaft of a motor and the vane is rotated by the driving force of the motor, thereby opening and closing the air discharge port, and adjusting the direction of air discharged from the air discharge port.

However, when the air discharged from the air discharge port is directly transmitted to a user, the user may feel that it is too cold or may feel uncomfortable due to the smell mixed in the discharge air. In order to solve this problem, recently, an indirect wind type ceiling air conditioner in which air discharged from an air discharge port is not directly transmitted to a user has been developed.

Since the indirect wind type ceiling air conditioner does not need to adjust the direction of the air discharged from the air discharge port, it is not necessary to have the vane, and the air discharge port is formed in a ring shape or arc shape so that the air can be spread in the circumferential direction.

Korean Patent Publication No. 10-2018-0129075 (published Dec. 5, 2018, hereinafter referred to as 'prior art') discloses a ceiling type air conditioner in which an air discharge port is formed in a ring shape or an arc shape.

In the conventional art, in order to provide indirect wind to a user, an air guide module 100 for converting the airflow discharged from the air discharge port into a horizontal airflow is installed. That is, as an air guide 110 is raised due to the drive of the motor, the air guide module 100 converts the air flow discharged from the air discharge port into a horizontal air flow.

However, since the prior art has difficulty in securing a space 60*a* in which the air guide module 100 can be installed on the outer circumferential surface of an inner flow path body 60, there was a need for a technology that can maximize the horizontal air flow without installing the air guide module 100.

In the prior art, if the air guide module 100 is not installed on the outer circumferential surface of the inner flow path body 60, the horizontal airflow should be realized by changing the shape of the outer circumferential surface of the inner flow path body 60.

Meanwhile, as shown in FIG. 9 of the prior art, the outer circumferential surface of the inner flow path body 60 occupies most of a concave inner guide 64. In addition, as shown in FIG. 16 of the prior art, a portion forming a lower end 67 of the outer circumferential surface of the inner flow path body 60 is formed vertically. In addition, as shown in FIG. 9 of the prior art, a space between the lower end of the inner guide 64 and the lower end 67 is connected by an inclined portion (not shown) inclined downward. That is, the inclined portion is extended inclined downward from the lower end of the inner guide 64, and the lower end 67 is extended vertically downward from the lower end of the inclined portion.

DISCLOSURE OF INVENTION

Technical Problem

The air discharged from the air discharge port has a characteristic to flow on a wall surface due to a Coanda effect. In the prior art, due to the inclined portion extended inclined downward, the air passed through the inclined portion has a strong characteristic to flow on the lower end 67, so that there is a problem in that it is difficult to implement the horizontal air flow.

Solution to Problem

An object of the present disclosure is to provide a ceiling-type air conditioner that can implement a horizontal air flow for providing an indirect wind to a user with a simple structure.

In order to achieve the above object, in the ceiling type air conditioner according to the present disclosure, a blower passage for guiding the air passed through a heat exchanger downward is formed in an inner case in which a blower and a heat exchanger are built-in. An inner flow path body is disposed below the inner case and has a suction flow path for sucking air into the inner case so as to communicate vertically. An outer flow path body is spaced outward from the inner flow path body and disposed below the inner case, and forms a discharge flow path, between the inner flow path body, communicating with the blow passage. An outer circumferential surface of the inner flow path body is provided with a first concave portion, a first horizontal portion, and a vertical portion. The first concave portion is formed to be concave, the first horizontal portion is extended horizontally outwardly from a lower end of the first concave portion, and the vertical portion is extended vertically downwardly from an outer end of the first horizontal portion.

The outer flow path body may have a convex portion that is convexly formed toward the first concave portion, and a lower portion of the first concave portion is protruded below the convex portion.

The vertical portion is disposed in the outer side than an upper end of the convex portion in a horizontal direction, and is disposed in the inner side than a lower end of the convex portion in the horizontal direction.

A suction panel which covers a lower side of the suction flow path may have a plurality of through holes communicating with the suction flow path, and have an edge end protruded upward. A lower portion of the vertical portion is inserted into the inner side of the edge end, and an upper end of the vertical portion is positioned higher than an upper end of the edge end. Here, a step from the upper end of the vertical portion to the upper end of the edge end is formed to be 3 mm or more.

The suction panel which covers a lower side of the suction flow path may have a plurality of through holes communicating with the suction flow path, and have an edge end protruded upward. The vertical portion is inserted into the inner side of the edge end, and an upper end of the vertical portion is positioned in the same height as an upper end of the edge end. Here, a step a step from the upper end of the edge end to a lower end of the edge end is formed to be 3 mm or more.

The suction panel which covers a lower side of the suction flow path may have a plurality of through holes communicating with the suction flow path. The vertical portion is positioned in the same vertical line as an edge end of the suction panel. Here, a step from an upper end of the vertical portion to a lower end of the edge end is formed to be 3 mm or more.

A lower end of the first concave portion is positioned in the same vertical line as the upper end of the convex portion.

An outer case covering an outer circumferential surface of the inner case and an outer circumferential surface of the outer flow path body may be provided with a second horizontal portion extended in the horizontal direction from the lower end of the convex portion.

A drain panel which is disposed above the inner flow path body may receive condensed water falling from the heat exchanger, and an outer circumferential surface of the drain panel forms a second concave portion extended upward from an upper end of the first concave portion.

An upper end of the second concave portion may be positioned in the same horizontal line as an upper end of a convex portion.

An air guide may enter and exit vertically through an opening between the lower end of the convex portion and the second horizontal portion. A drive unit disposed in an inner side of the outer case may move the air guide vertically.

The drive unit may include a motor, a pinion, and a rack. The pinion may be coupled to a rotation shaft of the motor, and the rack may be formed in the air guide and be engaged with the pinion.

Details of other embodiments are included in the detailed description and drawings.

Advantageous Effects of Invention

In the ceiling type air conditioner according to the embodiments of the present disclosure, the outer circumferential surface of the inner flow path body has the first concave portion, the first horizontal portion, and the vertical portion. The first concave portion is formed to be concave, the first horizontal portion is extended horizontally outward from the lower end of the first concave portion, and the vertical portion is extended vertically from the outer end of the first horizontal portion to the lower side. Therefore, since the vertical portion is bent 90 degrees downward from the lower end of the first horizontal portion, the flow direction of air passed through the first horizontal portion does not flow on the vertical portion, but the air flows while maintaining the flow direction of flowing on the first horizontal portion, thereby forming the horizontal airflow The effects of the present disclosure are not limited to the effects mentioned above, and other effects not mentioned can be clearly understood by those skilled in the art from the description of the claims.

BRIEF DESCRIPTION OF DRAWINGS

FIG. 1 is a bottom perspective view of a ceiling type air conditioner according to a first embodiment of the present disclosure;

FIG. 2 is a top perspective view of a ceiling type air conditioner according to a first embodiment of the present disclosure;

FIG. 3 is a side cross-sectional view of a ceiling type air conditioner according to a first embodiment of the present disclosure;

FIG. 4 is an enlarged view of a portion A divided by a dotted line in FIG. 3;

FIG. 5 is a diagram illustrating a second embodiment of FIG. 4;

FIG. 6 is a diagram illustrating a third embodiment of FIG. 4; and

FIG. 7 is a diagram illustrating the air flow distribution in the room in a cooling mode of the air conditioner according to a structure shown in FIGS. 4 to 6.

BEST MODE FOR CARRYING OUT THE INVENTION

A ceiling type air conditioner according to an embodiment of the present disclosure will be described with reference to the drawings.

FIG. 1 is a bottom perspective view of a ceiling type air conditioner according to a first embodiment of the present disclosure, FIG. 2 is a top perspective view of a ceiling type air conditioner according to a first embodiment of the present disclosure, and FIG. 3 is a side cross-sectional view of a ceiling type air conditioner according to a first embodiment of the present disclosure.

Referring to FIGS. 1 to 3, a ceiling type air conditioner 10 according to the first embodiment of the present disclosure may be installed on a ceiling of a room. The ceiling type air conditioner 10 may suck the air in the room, heat-exchange the sucked air with a heat exchanger 26 installed therein, and then discharge the heat-exchanged air into the room.

The ceiling type air conditioner 10 may be installed on the ceiling so that the entire conditioner may protrude into the room. That is, the upper surface of the ceiling type air conditioner 10 may be in contact with the ceiling and the remaining portion may be protruded to be disposed below the ceiling.

The ceiling type air conditioner 10 may include an inner case 20, an outer case 30, an inner flow path body 40, and an outer flow path body 50.

The inner case 20 may have a cylindrical shape having an opened lower surface. An upper surface of the inner case 20 may form an outer shape of an upper surface of the ceiling type air conditioner 10. When the inner case 20 is viewed from above, the shape of an upper surface edge of the inner case 20 may be circular.

When the ceiling type air conditioner 10 is viewed from above or below, the shape of an outer edge of the ceiling type air conditioner 10 may be circular. In this case, a discharge flow path 18 described later may be formed in a ring shape at the bottom, or may be formed in a ring shape as a whole from the top to the bottom.

In addition, when the ceiling type air conditioner 10 is viewed from above or below, the shape of an outer edge of the ceiling type air conditioner 10 may be quadrangle. In this case, the lower portion of a discharge flow path 18 described later may be formed in a quadrangle, or may be formed in a quadrangular shape as a whole from the top to the bottom. In this case, the quadrangle may be a quadrangle having a curved corner portion.

Hereinafter, in the description, when the ceiling type air conditioner 10 is viewed from above or below, the ceiling type air conditioner 10 will be described based on the assumption that the shape of the outer edge has a circular shape.

A blower 25 and the heat exchanger 26 may be built in the inner case 20.

The blower 25 may include a fan 21 and a motor M for rotating the fan 21.

The fan 21 may include a shroud 22, a hub 23 spaced apart axially from the shroud 22, and a plurality of blades 24 spaced apart from each other along the circumferential direction between the shroud 22 and the hub 23.

The shroud 22 may be disposed spaced downward from the hub 23. The shroud 22 may be provided with an air suction port 22*a* that communicates vertically.

The hub 23 may be spaced upwardly from the shroud 22. A central portion of the hub 23 may have a shape in which the upper surface is concave and the lower surface is convexly curved.

At least a part of the motor M may be inserted into the concave upper surface of the center of the hub 23. The rotation shaft of the motor M may be coupled to the center of the hub 23.

When the motor M is driven, the fan 21 may be rotated. When the fan 21 is rotated, air may be sucked into the fan 21 through the air suction port 22*a*, and the air sucked into the fan 21 may be moved outward in the horizontal direction through between the shroud 22 and the hub 23 and may be moved to the heat exchanger 26.

The heat exchanger 26 may have a refrigerant flowing therein. The heat exchanger 26 may exchange heat of the air blown from the blower 25 with the refrigerant.

The heat exchanger 26 may be disposed outside in the horizontal direction than the blower 25. The heat exchanger 26 may be formed in a ring or plate shape.

When the heat exchanger 26 is formed in a ring shape, the blower 25 may be disposed inside the heat exchanger 26.

When the heat exchanger 26 is formed in a plate shape, a plurality of heat exchangers 26 may be provided spaced apart from each other, and the blower 25 may be disposed between the plurality of heat exchangers 26.

The inner case 20 may be provided with a blow passage 29 for guiding the air passed through the heat exchanger 26 downward. The blow passage 29 may be formed in the outer side in the horizontal direction than the heat exchanger 26. The blow passage 29 may have a lower surface that is opened.

The outer case 30 may form an outer shape of the circumferential surface of the ceiling type air conditioner 10. The outer case 30 may cover the outer circumferential surface of the inner case 20 and the outer circumferential surface of the outer flow path body 50.

The upper portion of the outer case 30 may form an inner space having a narrow upper side and a wide lower side. The lower portion of the outer case 30 may form an inner space having a wide upper side and a narrow lower side.

The inner flow path body 40 may be disposed below the inner case 20. The inner flow path body 40 may be provided with a suction flow path 41 for sucking air into the inner case 20 to communicate vertically.

The lower portion of the inner flow path body 40 may be protruded downward than the outer flow path body 50.

A drain panel 28 may be disposed below the inner case 20. The drain panel 28 may form a portion of the lower surface of the inner case 20. The drain panel 28 may receive condensed water dropped from the heat exchanger 26. A drain pump (not shown) may be installed in the drain panel 28, and the condensed water dropped from the heat exchanger 26 to the drain panel 28 may be discharged to the outside of the ceiling type air conditioner 10 due to driving the drain pump.

An upper end of the heat exchanger 26 may be coupled to an upper surface of the inside of the inner case 20, and a lower end of the heat exchanger 26 may be coupled to the drain panel 28.

The drain panel 28 may be disposed above the inner flow path body 40. An upper end of the inner flow path body 40 may be coupled to the drain panel 28.

The upper surface of the inner flow path body 40 may be formed concave. In addition, the drain panel 28 may be formed in a shape corresponding to the upper surface of the inner flow path body 40, and may be covered on the upper surface of the inner flow path body 40.

An orifice 27 may be further installed inside the inner case 20. The orifice 27 may guide the air sucked through the suction flow path 41 of the inner flow path body 40 to the fan 21.

The lower portion of the orifice 27 may be inserted into the drain panel 28. The lower outer circumferential surface of the orifice 27 may be coupled to the inner circumferential surface of the drain panel 28.

The upper end of the orifice 27 may be inserted into the air suction port 22*a* formed in the shroud 22.

The orifice 27 may have a cylindrical shape having the upper and lower ends that are opened. The lower portion of the orifice 27 may be formed to have a larger diameter than the upper portion of the orifice 27. The lower portion of the orifice 27 may be formed to have a diameter that is uniform vertically. The upper portion of the orifice 27 may be formed to have a narrow diameter at the center and a wide diameter at the upper and lower sides.

The suction flow path 41 formed in the inner flow path body 40 may have a larger diameter than the lower portion of the orifice 27.

The outer flow path body 50 may be spaced outward from the inner flow path body 40 and disposed below the inner case 20. That is, the inner flow path body 40 may be inserted into the outer flow path body 50.

The outer flow path body 50 may form a discharge flow path 18 between the inner flow path body 40 and the outer flow path body 50. The discharge flow path 18 may communicate with the blow passage 29. The discharge flow path 18 may discharge the air blown from the blow passage 29 to the outside of the ceiling type air conditioner 10.

The suction panel 16 may be disposed below the inner flow path body 40. The suction panel 16 may be coupled to the lower side of the inner flow path body 40. The suction panel 16 may cover the lower side of the suction flow path.

The suction panel 16 may be provided with a plurality of through holes 16*a* communicating with the suction flow path 41 formed in the inner flow path body 40. Among the plurality of through holes 16*a*, the through holes 16*a* positioned close to the center of the suction panel 16 may be formed to have a first diameter, and among the plurality of through holes 16*a*, the through holes 16*a* positioned outside the horizontal direction than the through holes 16*a* formed to have the first diameter may be formed to have a second diameter smaller than the first diameter.

When the motor M is driven, the indoor air is moved to the suction flow path 41 through the plurality of through holes 16*a*. Then, the air moved to the suction flow path 41 is moved to the fan 21 through the internal space of the orifice 27. The air moved to the fan 21 is blown through the blade 24 to the heat exchanger 26. Then, the air blown by the heat exchanger 26 is moved to the blow passage 29 after heat-exchanging with the refrigerant flowing in the heat exchanger 26. Then, the air moved to the blow passage 29 passes through the discharge flow path 18 and moves to the room.

Meanwhile, a drive unit 61, 62, 63 and the air guide 64 are installed inside the outer case 30. The air guide 64 may protrude downward of the outer case 30 or may be inserted into the outer case 30 by the driving of the drive unit 61, 62, 63. The drive unit 61, 62, 63 may move the air guide 64 vertically.

The ceiling type air conditioner 10 may be operated in a first operation mode in which the air guide 64 protrudes downward of the outer case 30. When the ceiling type air conditioner 10 is operated in the first operation mode, the air discharged through the discharge flow path 18 may be moved to the lower side than horizontal direction to provide direct wind to a user.

The ceiling type air conditioner 10 may be operated in a second operation mode in which the air guide 64 is inserted into the outer case 30. Here, when the air guide 64 is inserted into the outer case 30, the lower surface of the air guide 64 may coincide with the lower surface of the outer case 30 in the horizontal direction. When the ceiling type air conditioner 10 is operated in the second operation mode, the air discharged through the discharge flow path 18 may be formed as horizontal airflow to provide indirect wind to a user.

The air guide 64 may enter and exit vertically through an opening 33 between the lower end of a convex portion 51 described later and a second horizontal portion 31.

The drive unit 61, 62, 63 may include a motor 61, a pinion 62, and a rack 63. The pinion 62 may be coupled to the rotation shaft of the motor 61, and the rack 63 may be formed in the air guide 64 and may be engaged with the pinion 62.

When the rotation shaft of the motor 61 is rotated in one direction, the air guide 64 may protrude downward of the outer case 30. When the rotation shaft of the motor 61 is rotated in the other direction, the air guide 64 may be inserted into the outer case 30.

Meanwhile, the air discharged through the discharge flow path 18 has a characteristic of flowing on the wall surface due to the Coanda effect.

When the ceiling type air conditioner 10 is operated in the second operation mode for providing indirect wind to the user, the outer circumferential surface of the inner flow path body 40 has a special structure in order to maximize the horizontal air flow due to the Coanda effect. The special structure of the outer circumferential surface of the inner flow path body 40 will be described below with reference to FIGS. 4 to 6.

FIG. 4 is an enlarged view of a portion A divided by a dotted line in FIG. 3.

Referring to FIGS. 3 and 4, the outer circumferential surface of the inner flow path body 40 may include a first concave portion 42, a first horizontal portion 43, and a vertical portion 44. The first concave portion 42 may be disposed in the upper side of the first horizontal portion 43, and the first horizontal portion 43 may be disposed in the upper side of the vertical portion 44. That is, the first concave portion 42, the first horizontal portion 43, and the vertical portion 44 may be disposed sequentially from the upper side to the lower side.

The first concave portion 42 may be formed concave. The first concave portion 42 may be formed as a concave curved surface. The first concave portion 42 may occupy most of the inner flow path body 40.

The first horizontal portion 43 may be extended horizontally from the lower end of the first concave portion 42 to the outside.

The vertical portion 44 may be vertically extended downward from the outer end of the first horizontal portion 43.

Since an angle between the first horizontal portion 43 and the vertical portion 44 is formed to be 90 degrees, when air is discharged through the discharge flow path 18, the Coanda effect may be weakened at the upper end of the vertical portion 44 which is an outer end of the first horizontal portion 43. Therefore, the air which passed through the first concave portion 42 and the first horizontal portion 43 sequentially has a weak characteristic of flowing along the vertical portion 44, at the upper end of the vertical portion 44 which is the outer end of the first horizontal portion 43, and may escape from the first horizontal portion 43 while maintaining the direction of flowing on the first horizontal portion 43, thereby forming a horizontal airflow.

If the first horizontal portion 43 is not formed between the first concave portion 42 and the vertical portion 44, and if an inclined portion having an outer angle, formed with respect to the upper end of the vertical portion 44, that is greater than 90 degrees is formed between the first concave portion 42 and the vertical portion 44 instead of the first horizontal portion 43, the flow of air passed through the inclined portion may have a continuity to flow on the vertical portion 44 at the upper end of the vertical portion 44, so that it may be difficult to form a large amount of horizontal airflow.

However, in the present embodiment, since the first horizontal portion 43 is formed between the first concave portion 42 and the vertical portion 44, the flow of air passed through the first horizontal portion 43 may have a discontinuity not to flow on the vertical portion 44 at the upper end of the vertical portion 44, so that a large amount of horizontal airflow can be formed.

The outer flow path body 50 may have a convex portion 51. The convex portion 51 may be formed convexly toward the first concave portion 42.

The lower portion of the first concave portion 42 may protrude downward of the convex portion 51.

The vertical portion 44 may be disposed outside in the horizontal direction than the upper end of the convex portion 51. In addition, the vertical portion 44 may be disposed inside in the horizontal direction than the lower end of the convex portion 51. That is, the vertical portion 44 may be disposed between the upper end of the convex portion 51 and the lower end of the convex portion 51 in the horizontal direction.

In other words, the outer end of the first horizontal portion 43 may be disposed outside in the horizontal direction than the upper end of the convex portion 51. The outer end of the first horizontal portion 43 may be disposed inside in the horizontal direction than the lower end of the convex portion 51. That is, the outer end of the first horizontal portion 43 may be disposed between the upper end of the convex portion 51 and the lower end of the convex portion 51 in the horizontal direction.

The lower end of the first concave portion 42 may be positioned on the same vertical line L1 as the upper end of the convex portion 51. That is, the inner end of the first horizontal portion 43 may be positioned on the same vertical line L1 as the upper end of the convex portion 51.

In other words, the lower end of the first concave portion 42 may be disposed in a position that vertically coincides with the upper end of the convex portion 51. That is, the inner end of the first horizontal portion 43 may be disposed in a position that vertically coincides with the upper end of the convex portion 51.

The outer case 30 may have a second horizontal portion 31 extended in the horizontal direction from the lower end of the convex portion 51. When air is discharged through the discharge flow path 18, the air flowing on the convex portion 51 flows on the second horizontal portion 31 in the horizontal direction, and thus a horizontal airflow may be formed.

The drain panel 28 may be provided with a second concave portion 28*a* extended upward from the upper end of the first concave portion 42. The second concave portion 28*a* may be formed concave.

The second concave portion 28*a* may be an outer circumferential surface of the drain panel 28. That is, the outer circumferential surface of the drain panel 28 may form a second concave portion 28*a* extended upward from the upper end of the first concave portion 42.

The upper end of the second concave portion 28*a* may be positioned in the same horizontal line L2 as the upper end of the convex portion 51. That is, the upper end of the second concave portion 28*a* may be disposed in a position coincident with the upper end of the convex portion 51 in the horizontal direction. In other words, the upper end of the second concave portion 28*a* may be positioned in the same height as the upper end of the convex portion 51.

Meanwhile, the suction panel 16 may have an edge end 16*b* protruded upward.

The lower portion of the vertical portion 44 may be inserted into the inner side of the edge end 16*b*, and the upper end of the vertical portion 44 may be positioned higher than the upper end of the edge end 16*b*. That is, the lower portion of the vertical portion 44 may be inserted into the inner side of the edge end 16*b*, and the upper portion of the vertical portion 44 may be disposed to protrude upward from the inner side of the edge end 16*b*. Here, a step from the upper end of the vertical portion 44 to the upper end of the edge end 16*b* may be formed to be 3 mm or more.

FIG. 5 is a diagram illustrating a second embodiment of FIG. 4. Here, the same reference numerals are given to the same elements as in FIG. 4, and detailed description thereof will be omitted, and only different points will be described.

Referring to FIG. 5, it can be seen that the inner flow path body 40 of the ceiling type air conditioner 10 according to a second embodiment of the present disclosure is different from the first embodiment described above.

That is, in FIG. 4, the suction panel 16 has an edge end 16*b* protruded upward, the vertical portion 44 is inserted into the inner side of the edge end 16*b*, and the upper end of the vertical portion 44 may be disposed in a position higher than the upper end of the edge end 16*b*. However, in the second embodiment, the vertical portion 44 may be inserted into the inner side of the edge end 16*b*, and the upper end of the vertical portion 44 may be positioned in the same height as the upper end of the edge end 16*b*. That is, in the second embodiment, the vertical portion 44 may be completely inserted into the inner side of the edge end 16*b*. Here, a step G from the upper end of the edge end 16*b* to the lower end of the edge end 16*b* may be formed to be 3 mm or more.

FIG. 6 is a diagram illustrating a third embodiment of FIG. 4. Here, the same reference numerals are given to the same elements as in FIG. 4, and detailed description thereof will be omitted, and only different points will be described.

Referring to 6, it can be seen that the inner flow path body 40 of the ceiling type air conditioner 10 according to the third embodiment of the present disclosure is different from the above-described first embodiment.

That is, in FIG. 4, the suction panel 16 has the edge end 16*b* protruded upward, the vertical portion 44 is inserted into the inner side of the edge end 16*b*, and an upper end of the vertical portion 44 may be disposed in a position higher than the upper end of the edge end 16*b*. However, in the third embodiment, the edge end 16*b* of the suction panel 16 is not protruded upward, and the vertical portion 44 may be positioned on the same vertical line L3 as the edge end 16*b* of the suction panel 16. Here, a step G from the upper end of the vertical portion 44 to the lower end of the edge end 16*b* may be formed to be 3 mm or more.

FIG. 7 is a diagram illustrating the air flow distribution in the room in a cooling mode of the air conditioner according to a structure shown in FIGS. 4 to 6.

FIG. 7 compares a first case in which the step G shown in FIGS. 4 to 6 is set to 2 mm with a second case the step G is set to 3 mm. In both the first case and the second case, the air conditioner 10 is operated for 60 minutes in the cooling mode at the same set temperature, and then the temperature distribution of each air flow is measured at the height of 0.1 m, the height of 1.1 m, and the height of 2.1 m from the indoor floor.

The 0.1 m upward from the floor is a height when the equipment for measuring the temperature distribution of the airflow is placed on the floor, the height is increased from the 0.1 m by 1 m, and then the temperature distribution of the airflow is measured at the 0.1 m, the 1.1 m, and the 2.1 m.

In FIG. 7, the color of the image indicates a low temperature distribution as it is closer to blue, and indicates a high temperature distribution as it is closer to red.

As shown in FIG. 7, it can be seen that the second case has more distribution of cold air than the first case. In particular, at 2.1 m height from the indoor floor, it can be seen that the second case has a significantly greater distribution of cold air than in the first case.

In the 2.1 m at the position higher than the 0.1 m and 1.1 m, the distribution of cold air in the second case is greater than in the first case, which means that greater horizontal airflow is formed than the vertical airflow with respect to the air discharged from the air conditioner 10

Accordingly, it can be seen that the second case has greater horizontal airflows than in the first case. In other words, if the step G is smaller than 3 mm, the flow direction of air flowing on the first concave portion 42 and the first horizontal portion 43 is vertically dropped while flowing on the vertical portion 44 due to the Coanda effect, and thus it can be seen that less horizontal airflow is formed. In addition, when the step G is 3 mm or more, in the flow direction of the air which flowed on the first concave portion 42 and the first horizontal portion 43, the amount of the air which is vertically dropped while flowing on the vertical portion 44 becomes small, so that it can be seen that greater horizontal airflow is formed.

That is, in order to allow the air discharged from the discharge flow path 18 to form a large amount of horizontal airflow, the step G is preferably formed to be 3 mm or more.

In the ceiling type air conditioner 10 according to the embodiments of the present disclosure, the outer circumferential surface of the inner flow path body 40 has the first concave portion 42, the first horizontal portion 43, and the vertical portion 44. The first concave portion 42 is formed to be concave, the first horizontal portion 43 is extended horizontally outward from the lower end of the first concave portion 42, and the vertical portion 44 is extended vertically from the outer end of the first horizontal portion 43 to the lower side. Therefore, since the vertical portion 44 is bent 90 degrees downward from the lower end of the first horizontal portion 43, the flow direction of air passed through the first horizontal portion 43 does not flow on the vertical portion 44, but the air flows while maintaining the flow direction of flowing on the first horizontal portion 43, thereby forming the horizontal airflow.

Although the exemplary embodiments of the present disclosure have been disclosed for illustrative purposes, those skilled in the art will appreciate that various modifications, additions and substitutions are possible, without departing from the scope and spirit of the invention as disclosed in the accompanying claims. Accordingly, the scope of the present disclosure is not construed as being limited to the described embodiments but is defined by the appended claims as well as equivalents thereto.

The invention claimed is:

1. A ceiling type air conditioner, comprising:

an inner case, in which a blower and a heat exchanger are disposed, and a blow passage that guides air passed through the heat exchanger downward is formed;

an inner flow path body, which is disposed below the inner case and has a suction flow path through which air is suctioned into the inner case; and an outer flow path body, which is spaced outward from the inner flow path body and disposed below the inner case, and forms a discharge flow path with the inner flow path body that communicates with the blow passage, wherein an outer circumferential surface of the inner flow path body comprises a first concave portion formed to be concave, a first horizontal portion that extends horizontally outwardly from a lower end of the first concave portion, and a vertical portion that extends vertically downwardly from an outer end of the first horizontal portion, wherein the outer flow path body comprises a convex portion that extends convexly toward the first concave portion, and wherein the first horizontal portion extended from the lower end of the first concave portion is located at a lower side in a vertical direction compared to a lowest end of the outer flow path body.

2. The ceiling type air conditioner of claim 1, wherein the lower end of the first concave portion is located at an outer side in a horizontal direction compared to an upper end of the convex portion.

3. The ceiling type air conditioner of claim 2, further comprising a suction panel which covers a lower side of the suction flow path, has a plurality of through holes that communicates with the suction flow path, and has an edge end that protrudes upward, wherein a lower portion of the vertical portion is inserted into an inner side of the edge end, and an upper end of the vertical portion is positioned higher than an upper end of the edge end.

4. The ceiling type air conditioner of claim 3, wherein a step from the upper end of the vertical portion to the upper end of the edge end is formed to be 3 mm or more.

5. The ceiling type air conditioner of claim 2, further comprising a suction panel which covers a lower side of the suction flow path, has a plurality of through holes that communicates with the suction flow path, and has an edge end that protrudes upward, wherein the vertical portion is inserted into the inner side of the edge end, and an upper end of the vertical portion is positioned at a same height as an upper end of the edge end.

6. The ceiling type air conditioner of claim 5, wherein a step from the upper end of the edge end to a lower end of the edge end is formed to be 3 mm or more.

7. The ceiling type air conditioner of claim 2, further comprising a suction panel which covers a lower side of the suction flow path, and has a plurality of through holes that communicates with the suction flow path, wherein the vertical portion is positioned along a same vertical line as an edge end of the suction panel.

8. The ceiling type air conditioner of claim 7, wherein a step from an upper end of the vertical portion to a lower end of the edge end is formed to be 3 mm or more.

9. The ceiling type air conditioner of claim 2, wherein the lower end of the first concave portion is positioned along a same vertical line as the upper end of the convex portion.

10. The ceiling type air conditioner of claim 2, further comprising an outer case that covers an outer circumferential surface of the inner case and an outer circumferential surface of the outer flow path body, wherein the outer case is provided with a second horizontal portion that extends in the horizontal direction from the lower end of the convex portion.

11. The ceiling type air conditioner of claim 1, further comprising a drain panel which is disposed above the inner flow path body, and receives condensed water falling from the heat exchanger, wherein an outer circumferential surface of the drain panel forms a second concave portion that extends upward from an upper end of the first concave portion.

12. The ceiling type air conditioner of claim 11, wherein an upper end of the second concave portion is positioned along a same horizontal line as an upper end of the convex portion.

13. The ceiling type air conditioner of claim 10, further comprising:

an air guide which enters and exits vertically through an opening between the lower end of the convex portion and the second horizontal portion; and a drive unit which is disposed at an inner side of the outer case, and moves the air guide vertically.

14. The ceiling type air conditioner of claim 13, wherein the drive unit comprises:

a motor;

a pinion which is coupled to a rotational shaft of the motor; and a rack which is engaged with the pinion, and is formed in the air guide.

15. A ceiling type air conditioner, comprising:

an inner case, in which a blower and a heat exchanger are disposed, and a blow passage that guides air passed through the heat exchanger downward is formed;

an inner flow path body, which is disposed below the inner case and has a suction flow path through which air is suctioned into the inner case;

an outer flow path body, which is spaced outward from the inner flow path body and disposed below the inner case, and forms a discharge flow path with the inner flow path body that communicates with the blow passage, wherein an outer circumferential surface of the inner flow path body comprises a first concave portion formed to be concave, a first horizontal portion that extends horizontally outwardly from a lower end of the first concave portion, and a vertical portion that extends vertically downwardly from an outer end of the first horizontal portion, wherein the outer flow path body comprises a convex portion that extends convexly toward the first concave portion, wherein a lower end of the first concave portion is located at a lower side in a vertical direction compared to a lower end of the convex portion;

an outer case that covers an outer circumferential surface of the inner case and an outer circumferential surface of the outer flow path body, and wherein the outer case is provided with a second horizontal portion that extends in a horizontal direction from the lower end of the convex portion.

16. The ceiling type air conditioner of claim 15, further comprising:

an air guide which enters and exits vertically through an opening between the lower end of the convex portion and the second horizontal portion; and a drive unit which is disposed at an inner side of the outer case, and moves the air guide vertically.

17. The ceiling type air conditioner of claim 16, wherein the drive unit comprises:

a motor;

a pinion which is coupled to a rotational shaft of the motor; and a rack which is engaged with the pinion, and is formed in the air guide.

18. A ceiling type air conditioner, comprising:

an inner case, in which a blower and a heat exchanger are disposed, and a blow passage that guides air passed through the heat exchanger downward is formed;

an inner flow path body, which is disposed below the inner case and has a suction flow path through which air is suctioned into the inner case;

an outer flow path body, which is spaced outward from the inner flow path body and disposed below the inner case, and forms a discharge flow path with the inner flow path body that communicates with the blow passage, wherein an outer circumferential surface of the inner flow path body comprises a first concave portion formed to be concave, a first horizontal portion that extends horizontally outwardly from a lower end of the first concave portion, and a vertical portion that extends vertically downwardly from an outer end of the first horizontal portion; and a drain panel, which is disposed above the inner flow path body, and receives condensed water falling from the heat exchanger, wherein an outer circumferential surface of the drain panel forms a second concave portion that extends upward from an upper end of the first concave portion.

19. The ceiling type air conditioner of claim 18, wherein an upper end of the second concave portion is positioned along a same horizontal line as an upper end of the convex portion.

* * * * *